US007199770B2

(12) United States Patent
Okuda

(10) Patent No.: US 7,199,770 B2
(45) Date of Patent: Apr. 3, 2007

(54) APPARATUS FOR DRIVING LIGHT-EMITTING DISPLAY

(75) Inventor: Yoshiyuki Okuda, Saitama (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 10/929,683

(22) Filed: Aug. 31, 2004

(65) Prior Publication Data

US 2005/0024304 A1 Feb. 3, 2005

Related U.S. Application Data

(63) Continuation of application No. 09/770,278, filed on Jan. 29, 2001, now Pat. No. 6,803,891.

(30) Foreign Application Priority Data

Jan. 27, 2000 (JP) ..... 2000-18330
Jan. 27, 2000 (JP) ..... 2000-18331

(51) Int. Cl.
*G09G 3/32* (2006.01)
*G09G 5/00* (2006.01)

(52) U.S. Cl. ..... 345/82; 345/76

(58) Field of Classification Search ..... 345/76, 345/77, 78, 80, 82, 87, 98, 99, 100
See application file for complete search history.

(56) References Cited

U.S. PATENT DOCUMENTS 4,901,155 A 2/1990 Hara et al.
5,986,640 A 11/1999 Baldwin et al.
5,990,629 A 11/1999 Yamada et al.
5,995,070 A 11/1999 Kitada
6,008,785 A * 12/1999 Hewlett et al. ..... 345/85
6,144,164 A 11/2000 Ito
6,243,082 B1 6/2001 Konishi
6,424,349 B1 7/2002 Kim
6,469,684 B1 * 10/2002 Cole ..... 345/58
6,476,779 B1 11/2002 Yano et al.

* cited by examiner

*Primary Examiner*—Dennis-Doon Chow
(74) *Attorney, Agent, or Firm*—Sughrue Mion, PLLC

(57) ABSTRACT

An apparatus for driving a light-emitting display controls the light-emission of light-emitting elements in such a manner that a driving current or driving voltage having a prescribed value to be supplied to the light-emitting elements is turned on or off by an on/off signal from a driving unit. The driving apparatus includes a pixel read section for reading the luminance values for the light-emitting elements in a frame period from an image signal and a ΔΣ modulator which operates in a sub-frame period which is 1/n of the frame period according to the luminance values read by the pixel read section. The output of "1" or "0" from ΔΣ modulator is served as the on/off signal. The driving apparatus can further includes a random data generator for providing random luminance values for the individual pixels. In an image displaying operation, the output from the random data generator is directly supplied to the ΔΣ modulator in place of the output from the pixel read section, or otherwise added to the output from the pixel read section. This configuration provides an image with good quality and naturalness in the luminance by the driving at low speed.

4 Claims, 5 Drawing Sheets

$(T_D = 1/n \cdot f_F)$

FIG. 4A
PRIOR ART
FIG. 4B
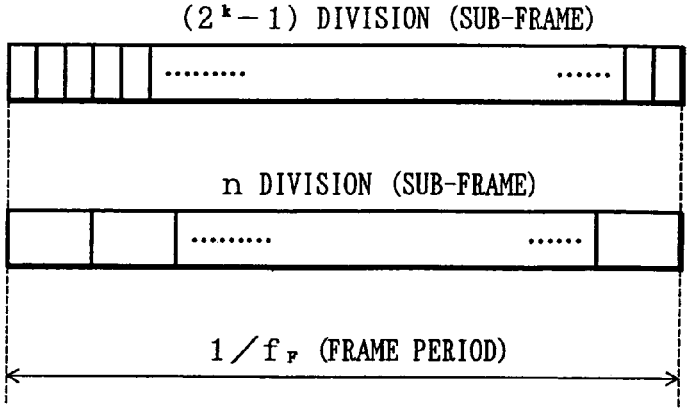
FIG. 6A
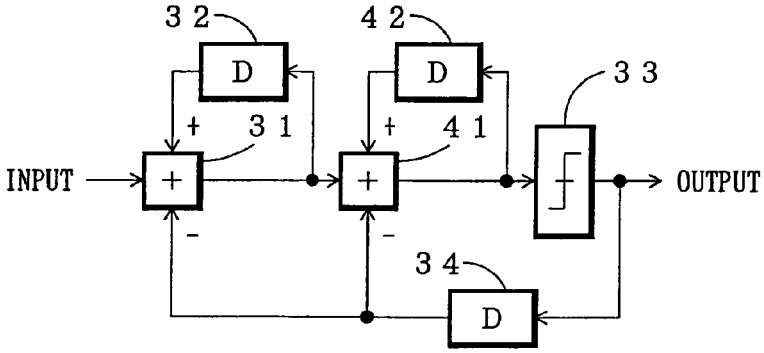
FIG. 6B
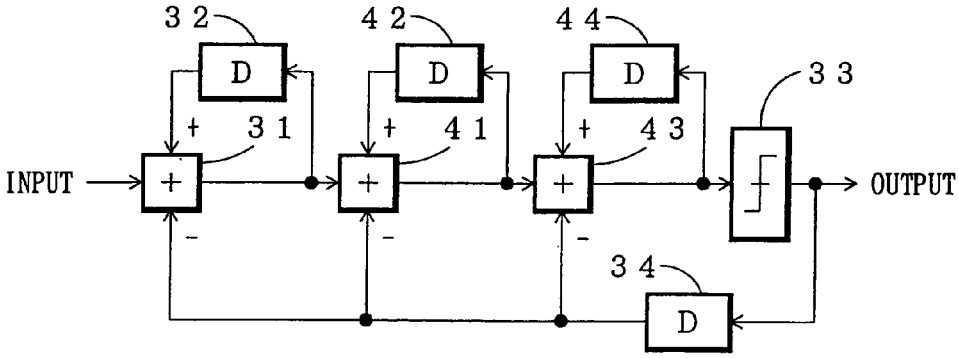

| ADDRESS (k) | | | PATTERN INFORMATION ($2^k-1$) | | | | | | |
|---|---|---|---|---|---|---|---|---|---|
| 0 | 0 | 0 | 0 | 0 | 0 | 0 | 0 | 0 | 0 |
| 0 | 0 | 1 | 1 | 0 | 0 | 0 | 0 | 0 | 0 |
| 0 | 1 | 0 | 1 | 0 | 0 | 0 | 1 | 0 | 0 |
| 0 | 1 | 1 | 1 | 0 | 1 | 0 | 0 | 1 | 0 |
| 1 | 0 | 0 | 1 | 0 | 1 | 0 | 1 | 0 | 1 |
| 1 | 0 | 1 | 1 | 1 | 1 | 0 | 1 | 0 | 1 |
| 1 | 1 | 0 | 1 | 1 | 1 | 0 | 1 | 1 | 1 |
| 1 | 1 | 1 | 1 | 1 | 1 | 1 | 1 | 1 | 1 |

51

APPARATUS FOR DRIVING LIGHT-EMITTING DISPLAY

This is a continuation of application Ser. No. 09/770,278 filed Jan. 29, 2001 now U.S. Pat. No. 6,803,891 The entire disclosure of the prior application, application Ser. No. 09/770,278 is considered part of the disclosure of the accompanying application and is hereby incorporated by reference.

BACKGROUND OF THE INVENTION

1. Field of the Invention

This invention relates to an apparatus for driving a light-emitting display constructed of light-emitting elements such as organic EL elements and light-emitting diodes.

2. Description of the Related Art

Where an image is displayed on the light-emitting display, each light-emitting element must be illuminated with the luminance corresponding to the luminance value of each of pixels of an image signal.

The technique for illuminating each light-emitting element with the luminance corresponding to the luminance value of the pixel includes an analog method and a time-divisional method.

The analog method is to vary the driving current of illuminating the light-emitting element according to the luminance value. The time-divisional method is to turn on/off the driving current, which is maintained constant, according to the luminance value, thereby varying its "ON" time.

The analog method requires linearity at high accuracy in order to vary the driving current according to the luminance value. Therefore, the analog method has a disadvantage that a driving section is up-sized and the value of the driving current varies according to a temperature.

On the other hand, in the time-divisional method in which requires a constant current to be produced, the driving section is down-sized and has a good temperature characteristic.

New referring to FIG. 11, an explanation will be given of a driving apparatus in a time-divisional system.

In FIG. 11 reference numeral 50 denotes a frame memory for storing an image signal (pixel data) corresponding to its one frame; 51 a pattern memory; 52 a read section; 53 a driving section for producing a constant driving current; and 54 a light-emitting display.

For simplicity of explanation, the explanation will be made for a single pixel.

The read section 51 reads the pixel data stored in the frame memory in a frame period.

The luminance value of the pixel data is represented by a binary number of k ($2^k$) Specifically, where k=8, the luminance is represented by 256 levels.

The pattern memory 51 stores schedule data (pattern information) for turning on the driving section 53 for the pixel data read by the read section 50.

FIG. 12 shows a concrete example of the contents of the pattern memory 51 where k=3.

The addresses of the pattern memory 51 are correlated with the pixel data read from the frame memory 50. The pattern information is recorded as the bit information of $2^k-1$.

Namely, where k=3, the address is represented by 3 bits and the pattern information is represented by 7 bits.

For example, as seen from FIG. 12, where the address is '000', the pattern information is '0000000', and where the address is '001', the pattern information is '1000000'. Likewise, the pattern information will be previously stored as seen from FIG. 12.

Using the addresses of the pixel data read from the frame memory 50, the read section 52 reads the pattern information stored in the pattern memory 51 and sequentially sends it to the driving unit 53 in a period of $1/(2^k-1)$ of the frame period.

Where the signal sent from the read section 52 is "1", the driving section 53 supplies a constant current to the light-emitting display 54, whereas the signal sent from the read section 52 is "0", the driving section 53 stops supply of the current.

Generally, the image data has the luminance values of 8 bits or larger, i.e. $2^k-1=255$ level or larger. In this case, the pattern memory requires 256 addresses and memory capacity of 255 bits.

In the conventional apparatus for driving a light-emitting display in a time-divisional manner, where the image signal is represented by a binary number of k, the driving section 53 is on/off controlled in a period of $1/(2^k-1)$ of the frame period, thereby requiring a high speed operation.

SUMMARY OF THE INVENTION

An object of this invention is to provide an apparatus for driving a light-emitting display which drives a driving section at a driving rate lower than e.g. $(2^k-1)f$ and equivalently provides the number of levels corresponding to $2^k$in a frequency band lower than $f_F/2$ which is a reproduction band of a moving image, i.e. Nyquist band.

In order to the above object, in accordance with an aspect of this invention, there is provided a driving apparatus for a light-emitting display which controls the light-emission of M number of light-emitting elements in such a manner that a driving current or driving voltage is turned on or off by an on/off signal supplied through a driving unit, comprising:

a pixel read section for reading the luminance values for the light-emitting elements in a frame period from an image signal; and a ΔΣ modulator which operates in a sub-frame period which is 1/n of the frame period according to the luminance values read by the pixel read section, wherein an output of "1" or "0" from ΔΣ modulator is supplied to the driving unit as the on/off signal.

In this configuration, the luminance value of the pixel is subjected to the ΔΣ modulation, and the driving current or the driving voltage is turned on/off using the output from the ΔΣ modulator. For this reason, even if the on/off frequency of the driving current or driving voltage is lowered, a necessary S/N ratio can be assured within a reproduction frequency band of an image.

In order to the above object, in accordance with another aspect of this invention, there is provided a driving apparatus for a light-emitting display which controls the light-emission of M number of light-emitting elements in such a manner that a driving current or driving voltage is turned on or off by an on/off signal supplied through a driving unit, comprising:

a pixel read section for reading the luminance values of the light-emitting elements in a frame period from an image signal;

a ΔΣ modulator which operates in a sub-frame period which is 1/n of the frame period according to the luminance values read by the pixel read section; and a random data generator for generating random luminance values of individual pixels, wherein in an image displaying operation, the output from the random data generator is directly supplied to the ΔΣ modulator in place of the output from the pixel read section, or otherwise added to the output from the pixel read section.

Where the random luminance values are supplied to the ΔΣ modulator when the driving apparatus is started, the blinking of the display can be prevented.

The above and other objects and features of this invention will be more apparent from the following description taken in conjunction with the accompanying drawings.

BRIEF DESCRIPTION OF THE DRAWINGS

FIGS. 4A and 4B are views each for explaining the period while a driving current is turned on/off;

FIGS. 6A and 6B are block diagrams of ΔΣ modulators according to the third embodiment of this invention;

DESCRIPTION OF THE PREFERRED EMBODIMENTS

Figure 1:
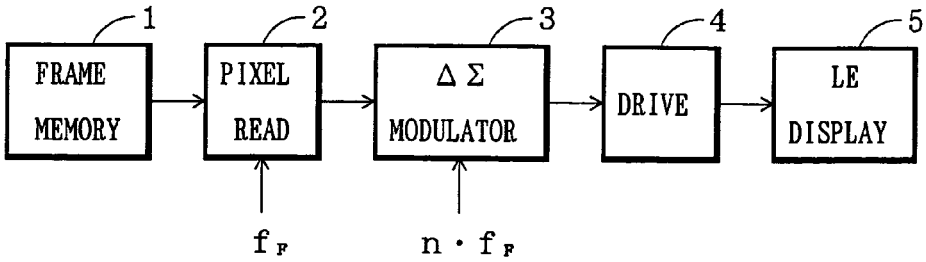
FIG. 1 is a block diagram of a basis construction of this invention.

Referring to FIG. 1 showing a block diagram of a basic construction of the invention, an explanation will be given of various embodiments of this invention.

In FIG. 1, reference numeral 1 denotes a frame memory in which pixel data are stored in a frame period; 2 a pixel read section which reads pixel data (luminance value) from the frame memory; 3 a ΔΣ modulator; and 4 a driving section for supplying a constant driving current or voltage to light-emitting elements constituting pixels of a light-emitting display 5.

Figure 2:
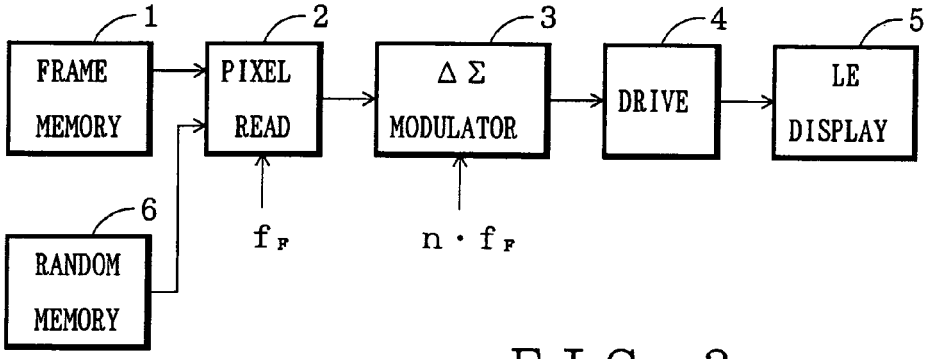
FIG. 2 is a block diagram of another basic construction of this invention.

FIG. 2 is a block diagram of another basic construction of this invention. As seen, a random memory 6 which stores random luminance values is added to the construction of FIG. 1. In FIG. 2, like reference numeral refers to like units in FIG. 1.

The pixel read section 2 reads the pixel data from the frame memory 1 in synchronism with the frame pulse $f_F$ repeated in a frame period. The read of the random luminance values stored in the random memory 6 will be explained later.

The driving section 4 on/off controls the driving current or voltage on the basis of a "1" or "0" signal which is produced from the ΔΣ modulator.

Figure 3:
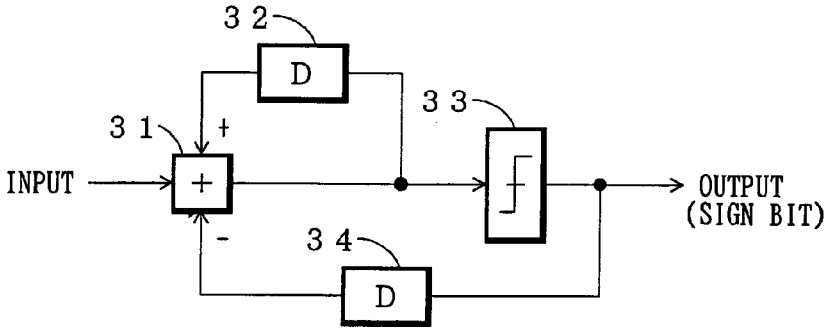
FIG. 3 is a block diagram of a ΔΣ modulator according the first embodiment of this invention.

FIG. 3 is a block diagram of the ΔΣ modulator according to the first embodiment of this invention.

In FIG. 3, reference numeral 31 denotes an addition unit; 32 and 34 denote a first and a second delay unit for delaying input pixel data by the time $T_D$which is 1/n of the frame period ($1/n \cdot f_F$ ($f_F$ is a frequency of the frame pulse); and 33 denotes a decision unit which produces a positive prescribed value if the output value from the addition unit 31 is a prescribed or larger value and produces a negative prescribed value if the output value is smaller than the prescribed value.

The first delay unit 32 delays the output from the addition unit 31. The addition unit 31 performs an addition of the delayed output and the input pixel data.

The output from the decision unit 33 is delayed by the second delay unit 34. The delayed output is subjected to subtraction by the addition unit 31.

The output to be supplied to the driving unit 4 produces a sign bit (if positive, "1", and if negative, "0") which represents the positive/negative of the signal produced from the decision unit 33.

An explanation will be given of the operation of the the ΔΣ modulator according to the first embodiment shown in FIG. 3.

For the period of a single frame, the pixel read section 2 supplies the pixel data to the addition unit 31. Subsequently, for the period of a next single frame, the pixel read section 2 supplies the pixel data (luminance value) at the same position in the next frame to the pixel read section 2.

The addition unit 31 adds the output value from the first delay unit 32 to the pixel data thus supplied. The addition unit 31 subtracts the output value from the second delay unit 34. The addition unit 31 sends the resultant output to the decision unit 33 which makes a decision of positive or negative.

The output from the addition unit 31 is delayed by $T_D$ ($=1/n \cdot f_F$) and the delayed output is sent back to the addition unit 31. The prescribed value outputted from the decision unit 33 is delayed by a time $T_D$, and the delayed output is sent back to the addition unit 31.

Therefore, the output from the addition unit 31 is changed for each of $T_D$ times. The changed addition result is decided by the decision unit 33. The sign bit which is the decision result is supplied to the driving unit 4 to turn on/off the driving current.

In this way, the control signal for on/off controlling the driving current for each of n-divided sub-frames is determined by the output value resulting from ΔΣ-modulation for each sub-frame of the luminance data for each frame of each pixel. For this reason, even when "n" is made smaller than $2^k-1$, a necessary S/N ratio is assured within a Nyquist band of $f_F/2$.This prevents the quality of the reproduced image from being attenuated.

As regards the image signal of a single pixel, the Nyquist band defined by ½ of the frame frequency is DC~$f_F/2$. The fact that the signal component within this frequency band has levels of $2^k$ means that the quantity of the noise component within the frequency band is not larger than $1/\sqrt{2} \cdot 2^k$.

When it is intended that the level is equivalently represented for each of sub-frames time-divided from the one frame period, the number n of time division must be generally $2^k-1$ or larger. In this case, as shown by ① in FIG. 10, the noise component which is a difference between an original signal and a reproduced signal has an amplitude of $1/\sqrt{2} \cdot 2^k$ and its frequency band extends ranges from DC~$n \cdot f^F/2$.

Figure 10:
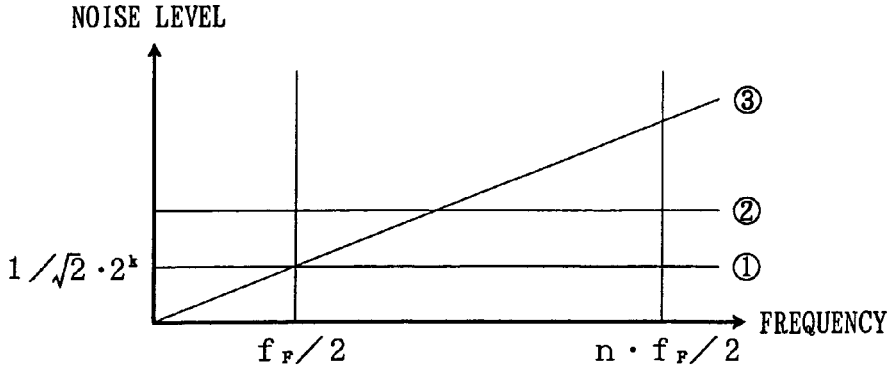
FIG. 10 is a graph showing the noise component.
Figures 11, 12:
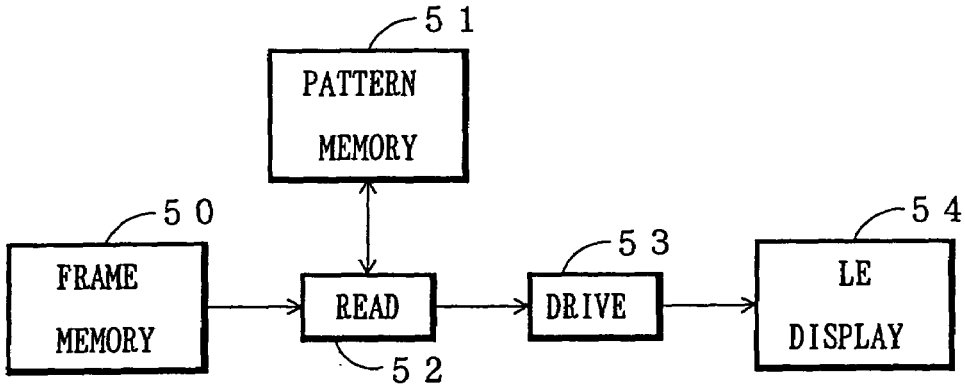
FIG. 11 PRIOR ART
FIG. 12 PRIOR ART
FIG. 11 is a block diagram of a prior art driving apparatus for a light-emitting display.
FIG. 12 is a view of a concrete example of the contents of a pattern memory in the prior art.

If the number n of the divided sub-frames is smaller than $2^k-1$, the noise level rises as shown by ② in FIG. 10 so that the necessary S/N ratio cannot be assured.

Now where the signal processing is carried out by the ΔΣ-modulator with $n<2^k-1$, the spectrum of noise is shifted toward the higher frequency as shown by ③ in FIG. 10. If attention is paid to only the frequency band of DC~$f_F$, the noise level can be reduced to not lower than $1/\sqrt{2\cdot 2^k}$ according to the value of n.

The function of ③ in FIG. 10 can be acquired from the equation of z-transform (the delay circuit can be represented by multiplication of a coefficient of $z^{-1}$). Specifically, assuming in FIG. 3 that the input is X, the output is Y and the noise component added by the addition unit is Q, $$Y=(X-z^{-1}Y)\{1/(1-z^{-1})\}+Q$$

Therefore, $$Y=X+Q(1-z^{-1})$$

Since the noise component Q is multiplied by $(1-z^{-1})$, it is similar to differentiation. This result in a characteristic which rises toward the higher frequency band with no DC component.

The secondary order ΔΣ modulator provides $$Y=X+Q(1-z^{31\ 1})$$

This exhibits the second-order differentiation characteristic, thereby providing a more abrupt shifting effect.

In the prior art, as shown in FIG. 4A, where the luminance value is composed of k bits, the driving current is on/off controlled for each of $2^k-1$ sub-frames divided from the frame period ($1/f_F$) On the other hand, in the first embodiment, as seen from FIG. 4B, the driving current is on/off controlled for each of n sub-frames divided from the frame period.

Now referring to FIG. 5, an explanation will be given of the second embodiment of this invention.

Figure 5:
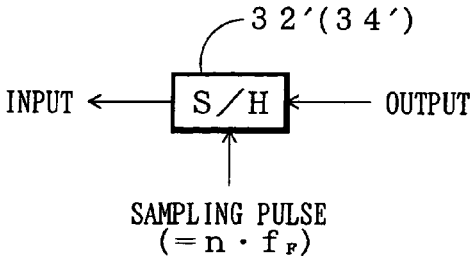
FIG. 5 is a view for explaining a sample-and-hold section according to the second embodiment of this invention.

In the first embodiment, the signal (pixel value) was delayed using the first delay unit 32 and the second delay unit 34, whereas in the second embodiment, these delay units is replaced by a sample-and-hold unit (S/H) 32' (34') as shown in FIG. 5.

The S/H unit 32' holds and outputs an input value whenever a sampling pulse is received. Therefore, if the frequency of the sampling pulse is set at the frequency which is n-times of the frequency $f_F$ of the frame pulse, i.e. $n\cdot f_F$, the pixel data can be delayed like the first delay unit 32 and second delay unit 34.

Referring to FIGS. 6A and 6B an explanation will be given of the third embodiment.

In the first embodiment, as shown in FIG. 3, the first-order ΔΣ modulator was used. In this embodiment, a second-order ΔΣ modulator as shown in FIG. 6A or a third-order ΔΣ modulator as shown in FIG. 6B is used.

As shown in FIG. 6A, the second-order ΔΣ modulator is constructed so that a second addition unit 41 and a third delay unit 42 are cascade-connected between the addition unit 31 and the decision unit 33 in the first-order ΔΣ modulator explained with reference to FIG. 1.

The second addition unit 41 makes the same operation as the addition unit 31. The delay time is set at the same time as that of the first delay unit 32 and the second delay unit 34.

As shown in FIG. 6B, the third-order ΔΣ modulator is constructed so that a third addition unit 43 and a fourth delay unit 44 are cascade-connected between the second addition unit 41 and the -decision unit 33 in the second-order ΔΣ modulator.

By raising the order of the ΔΣ modulator, the distribution of the noise component can be shifted toward the high frequency region so that the S/N ratio in the low frequency region is increased and naturalness of the displayed image can be further improved.

Returning to FIG. 2, an explanation will be given of the read of random pixel data stored in the random memory 6 by the pixel read section 2.

In the driving apparatus for a light-emitting display explained with reference to FIGS. 1 to 6, when the power is turned on, the outputs from the addition unit 31, 41 or 43 in the ΔΣ modulator 3 are 0 for all the pixels.

Therefore, where the pixel data inputted when the power is turned on is an image with random luminance values, no problem occurs. On the other hand, where the major part within a screen is occupied by pixels with low and equal luminance values, the period of the ON signals produced from the ΔΣ modulator is long and the ON signals are in phase between the pixels with equal phases because the outputs from the addition unit 31, 41 or 43 while the power is on.

Where the respective pixels on the light-emitting display are driven by the ON signals with the long period and in phase, the display emits light as if it were blinking.

In order to avoid such phenomenon of blinking, when the driving apparatus is started, the pixel read section 2 reads the luminance values of the pixels stored in the random memory 6 and supplies them to the ΔΣ modulator 3.

The random memory 6 has a capacity capable of the storing the luminance values of all the pixels and provides the pixels with random luminance values previously.

Therefore, by reading the luminance values stored in the random memory 6 when the driving apparatus is started, the output values of the addition unit 31 or the addition units 41 and 43 are different between the adjacent pixels. As a result, the timings of producing the ON signals from the decision unit 33 of the ΔΣ modulator 3 are random so that the above phenomenon of blinking does not occur.

Incidentally, the pixels read section 2 may read the random luminance values generated from a random value generator in place of the random memory 6 storing the random values.

Figure 7:
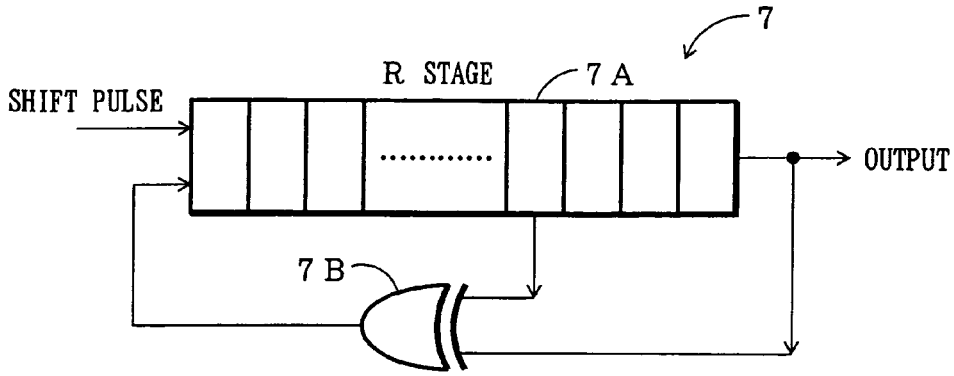
FIG. 7 is a schematic diagram of a random value generator.

FIG. 7 shows a concrete example of a random generator 7.

The random value generator 7 includes e.g. an R-stage shift register 7A and an exclusive OR (EX/OR) 7B.

The outputs at an intermediate and a final stage of the shift register 7A are supplied to the EX/OR 7B, and the output from the EX/OR 7B is supplied to the first stage of the shift register 7A.

When a shift pulse is supplied to the shift register 7A, the data of "1" or "0" is shifted according to the shift pulse. Thus, data in a random time series which are repeated at the period of $(2^R-1)$ bits are obtained from the output from the shift resister 7A.

Therefore, the read from the random memory 6 can be replaced by the read of the necessary bits of the random signal which is produced from the shift register 7A Referring to FIG. 8, an explanation will be given of the fourth embodiment of this invention.

In the first to third embodiments, the ΔΣ modulator was provided for each of the pixels. In this embodiment, a ΔΣ modulator is provided commonly for M pixels so that it performs a time-divisional operation.

Figure 8:
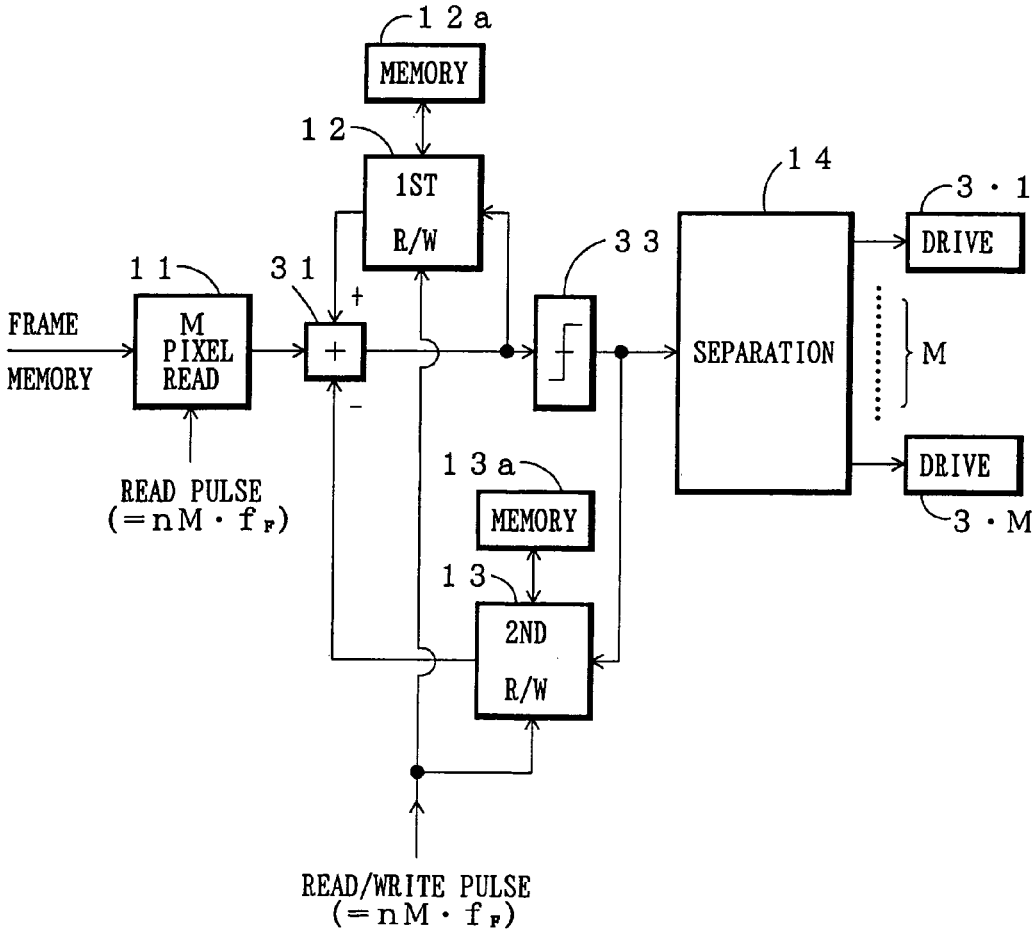
FIG. 8 is a block diagram of a ΔΣ modulator according to the fourth embodiment of this invention.

In FIG. 8, reference numeral 11 denotes a M pixel read section which sequentially reads the luminance values of the M pixels in synchronism with the read pulse at a frequency of $nM\cdot f_F$and supplies them to the addition section 31.

Reference numerals 12 and 13 denote a first and a second read/write section which are provided with a memory 12*a* and a memory 13*a* which store M pieces of data corresponding to the M pixels, respectively.

Reference numeral 33 denotes a decision section whose output is connected to a separation section.

The first and the second read/write section 12 and 13 perform the read/write operation in synchronism with the read/write pulse at the frequency of $nM \cdot f_F$ which is the same as the read pulse for the M pixel read section 11.

Specifically, the first and the second read/write section 12 and 13 read, from the memories 12*a* and 13*a*, the data corresponding to the pixels supplied to the addition section 31 from the M pixel read section 11 and supply them to the addition section 31. These data are added in the addition section 31.

In operation, in response to the read/write pulse, the first read/write section 12 writes the output value from the addition section 31 in the corresponding memory and also read the stored data corresponding to the pixels read by the M pixel read section 11 which are supplied to the addition section 31.

Like the first read/write section, the second read/write section 13 writes the output value from the decision section 33 and reads the stored data corresponding to the subsequent pixels which are supplied to the addition section 31.

A separating section 14 connects the output from the decision section 33 to driving units 3.1–3.M corresponding to the pixels read by the M pixel read section 11, and on/off controls the driving current for the driving units 3.1–3.M.

In FIG. 8, although M pixels are commonly used in the first-order ΔΣ modulation, the higher-order modulation may be carried out.

Where the M pixels are caused to correspond to the M pixels constituting the row or column of the light-emitting display, the number of the ΔΣ modulators can be reduced, and the driving units can be operated at a relative low speed.

Figure 9:
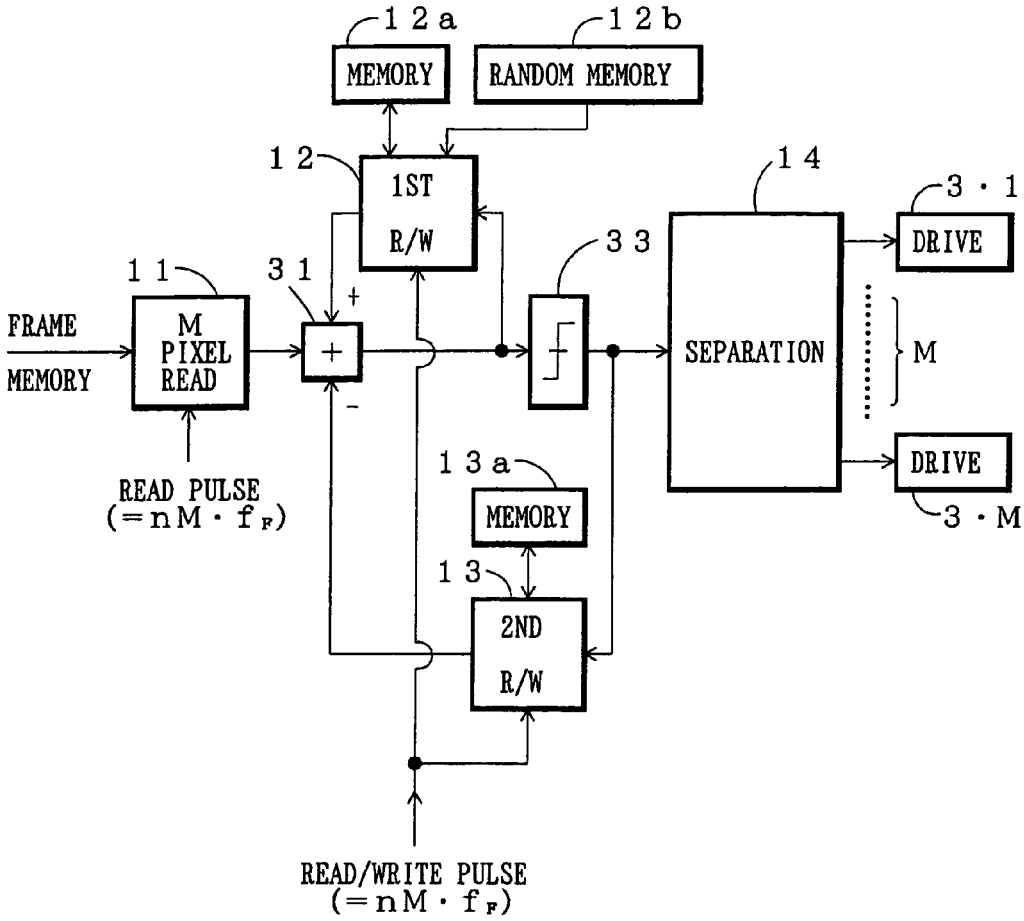
FIG. 9 is a block diagram of a ΔΣ modulator according to a modification of the fourth embodiment of this invention.

FIG. 9 shows a modification of the fourth embodiment of this invention. This modification is different from the fourth embodiment in that a random memory 12*b* which will be described below is added.

As described above, in order to remove the blinking of the light-emitting display 5, when the driving apparatus is started, the pixel read section 2 read the random luminance values from the random memory 6 or the random value generator 7 shown in FIG. 7.

The random memory 12*b* which stores the random values performs an alternative method to this method. Namely, when the driving apparatus is started, the first read/write section 12*b* reads the random luminance values stored in the random memory and supplies them to the addition unit 31.

More specifically, the random values read from the M pixel read section 11 are not supplied to the addition unit 31, but the random values read from the random memory 12 by the first read/write section 12 are supplied to the addition unit 31.

Incidentally, the random memory 12*b* may be connected to the second read/write section 13. In this case also, likewise, the random values read therefrom can be supplied to the addition unit 31.

In this modification, the random value generator 7 explained with reference to FIG. 7 may be used instead of the random memory 12*b*. In this case also, the random values read from the random value generator 7 by the first read/write section 12 or the second read/write section 13 are supplied to the addition unit 31.

[Effects of the Invention]

As understood from the description hitherto made, in accordance with this invention, the luminance value of the pixel is subjected to the ΔΣ modulation, and the driving current or the driving voltage is turned on/off using the output from the ΔΣ modulator. For this reason, even if the on/off frequency of the driving current or driving voltage is lowered, a necessary S/N ratio can be assured within a reproduction frequency band of an image.

Where the random luminance values are supplied to the ΔΣ modulator when the driving apparatus is started, the blinking of the display can be prevented.

What is claimed is:

1. A driving apparatus for a light-emitting display which controls the light-emission of M number of light-emitting elements in such a manner that a driving current or driving voltage is turned on or off by an on/off signal supplied through a driving unit, comprising:

a pixel read section for reading the luminance values of the light-emitting elements in a frame period from an image signal;

a ΔΣ modulator which operates in a sub-frame period which is 1/n of the frame period according to the luminance values read by the pixel read section; and a random data generator for generating random luminance values of individual pixels, wherein in an image displaying operation, the output from the random data generator is directly supplied to the ΔΣ modulator in place of the output from the pixel read section, or otherwise added to the output from the pixel read section.

2. The driving apparatus for the light-emitting display according to claim 1 wherein the M number of light emitting elements are arranged in a row or column.

3. The driving apparatus for the light-emitting display according to claim 1, wherein the random data generator is constructed of pixel memories with random data for the pixels.

4. The driving apparatus for the light-emitting display according to claim 1, wherein the frame period is divided into n equal sub-frame periods.

* * * * *